US010334954B1

(12) United States Patent
Horowitz

(10) Patent No.: US 10,334,954 B1
(45) Date of Patent: Jul. 2, 2019

(54) COLLAPSIBLE AND FOLDABLE PORTABLE BENCH

(71) Applicant: Brian Horowitz, Lake Forest, CA (US)

(72) Inventor: Brian Horowitz, Lake Forest, CA (US)

( * ) Notice: Subject to any disclaimer, the term of this patent is extended or adjusted under 35 U.S.C. 154(b) by 0 days.

(21) Appl. No.: 15/958,338

(22) Filed: Apr. 20, 2018

(51) Int. Cl.
*A47C 11/00* (2006.01)
*A47C 4/28* (2006.01)
*A47C 1/124* (2006.01)

(52) U.S. Cl.
CPC ..... *A47C 11/005* (2013.01); *A47C 1/124* (2013.01); *A47C 4/286* (2013.01)

(58) Field of Classification Search
CPC ..... A47C 4/286; A47C 1/124; A47C 11/005
See application file for complete search history.

(56) References Cited

U.S. PATENT DOCUMENTS 1,738,473 A * 12/1929 Green ..... A47C 4/283 297/232
1,858,254 A * 5/1932 Uline ..... A47C 4/283 297/248
3,162,484 A * 12/1964 Kleffman ..... A47B 87/008 297/248
3,383,738 A * 5/1968 Fox ..... A47C 1/124 24/306
3,492,046 A * 1/1970 Freda ..... A47C 1/124 297/248
3,640,568 A * 2/1972 Suzuki ..... A47C 1/12 297/232
3,669,491 A * 6/1972 Weslock ..... A47C 1/124 24/339
3,706,471 A * 12/1972 Shimosawa ..... A47B 83/02 297/158.1
4,066,373 A * 1/1978 Workman ..... A47C 1/124 24/339
4,662,679 A * 5/1987 Franck ..... A47C 11/005 297/240
5,340,193 A * 8/1994 Wolf ..... A47C 4/42 297/188.02

(Continued)

FOREIGN PATENT DOCUMENTS

DE 1109846 B * 6/1961 ..... A47C 1/124
DE 2655601 A1 * 6/1978 ..... A47C 1/124

(Continued)

*Primary Examiner* — Timothy J Brindley
(74) *Attorney, Agent, or Firm* — Morland C. Fischer

(57) ABSTRACT

Disclosed is a collapsible and foldable portable bench having a number of flexible seats that are aligned side-by-side one another upon which a corresponding number of individuals can be seated. The seats are attached to and held up by respective frames that are pivotally connected together by C-shaped couplers to enable the frames to rotate relative to one another and the bench to be moved between axially expanded (i.e., straight line), folded (i.e., curved) and collapsed (i.e., compressed) configurations in response to pulling, pushing and bending forces applied thereto. In its collapsed configuration, the bench has a compact size that is suitable for storage or transport in a backpack or inside the hatch of a motor vehicle. To facilitate the manipulation of the bench from one configuration to another, a flexible triangular web is attached between each pair of adjacent seats.

14 Claims, 5 Drawing Sheets

(56) References Cited

U.S. PATENT DOCUMENTS

| | | | | | |
|---|---|---|---|---|---|
| 5,529,427 | A * | 6/1996 | Bost | A47C 1/124 | 280/250.1 |
| 5,570,928 | A * | 11/1996 | Staunton | A47C 4/283 | 297/232 |
| 6,231,119 | B1 * | 5/2001 | Zheng | A47C 4/286 | 297/16.2 |
| 6,454,348 | B1 * | 9/2002 | Wu | A47C 4/286 | 297/16.2 |
| D575,962 | S * | 9/2008 | Senko | D6/381 | |
| 2003/0154660 | A1 * | 8/2003 | Berkowicz | A47C 1/124 | 52/8 |
| 2004/0207240 | A1 * | 10/2004 | Tondino | A47C 1/12 | 297/248 |
| 2015/0335169 | A1 * | 11/2015 | Lin | A47C 31/00 | 24/517 |
| 2016/0095434 | A1 * | 4/2016 | Lin | A47B 87/007 | 24/517 |

FOREIGN PATENT DOCUMENTS

| | | | | | |
|---|---|---|---|---|---|
| DE | 9309401 | U1 * | 12/1993 | A47C 1/124 | |
| DE | 10227837 | A1 * | 1/2004 | A47C 4/283 | |
| GB | 403387 | A * | 12/1933 | A47C 4/283 | |
| GB | 828246 | A * | 2/1960 | A47C 1/124 | |
| JP | H0736780 | U * | 7/1995 | A47C 11/005 | |
| JP | 08173266 | A * | 7/1996 | A47C 1/124 | |
| JP | 2001161496 | A * | 6/2001 | A47C 11/005 | |
| WO | WO-0247514 | A1 * | 6/2002 | A47C 4/286 | |

* cited by examiner

COLLAPSIBLE AND FOLDABLE PORTABLE BENCH

BACKGROUND OF THE INVENTION

1. Field of the Invention

This invention relates to a comfortable and foldable portable bench that is adapted to be manually manipulated by a user who applies pulling or pushing force thereto to cause the bench to assume any one of axially expanded (i.e., straight line), folded (i.e., curved), or collapsed (i.e., compressed) configurations. The bench includes a plurality of flexible seats that are mounted side-by-side on respective frames which are pivotally connected to one another to facilitate the manipulation of the bench into one of the aforementioned configurations.

2. Background Art

Benches have long been used both inside or out of doors to provide seating for a number of people. By way of example only, a bench can be commonly found at an outside sporting event or at an indoor meeting area. The conventional bench typically has a hard elongated seat made of wood, plastic or metal to provide a continuous surface on which individuals are seated one next to the other. The hard seating surface is often uncomfortable particularly if the individuals will remain seated for a long time. Moreover, the seated individuals are sometimes pressed against one another which may lead to additional discomfort.

What is more, because of its rigid construction and elongated size, it can be difficult to transport the conventional bench from place-to-place. In particular, the conventional bench may prove to be too large to be easily transported in a standard automobile or stored in a compact space when it is not in use. Likewise, lifting and moving the bench around tight corners may be troublesome for a single individual particularly in those cases where the bench is lengthy. In this same regard, the rigid seating surface thereof makes it virtually impossible to bend or fold the conventional bench so as to have a curved configuration as would be ideal to provide intimate, close proximity seating when listening to a speaker, watching a performer or surrounding a campfire or a round table.

Accordingly, it would be desirable to have available an improved collapsible, foldable and conveniently portable bench having a shape that can be easily reconfigured by a user to increase the application and facilitate the storage of the bench while overcoming the disadvantages described above that are inherent in conventional rigid benches.

SUMMARY OF THE INVENTION

In general terms, a comfortable, foldable and easily portable bench is disclosed to be used both indoors and out of doors to enable users to listen to a speaker or a performer or surround a campfire or a round table. The bench is responsive to pulling and pushing forces applied to opposite ends thereof to cause the bench to assume any one of axially expanded (i.e., straight line), folded (i.e., curved), or collapsed (i.e., compressed) configurations. When pushing forces are applied to opposite ends thereof, the bench will assume its collapsed configuration so as to have a compact size that is ideal for storage or to be carried in a backpack strapped to the back of an individual.

The bench includes a plurality of rectangular seats in which a corresponding plurality of individuals are seated side-by-side one another. Each seat of the bench is attached to and held above the ground by a frame. The frame of each seat includes X-shaped braces having legs that are connected between lower floor blocks that lay on the ground and upper seat blocks that are affixed underneath the corners of the seat by means of fasteners. An X-shaped brace is located at the front, rear and opposite sides of each frame. One lower floor block from the frames of each pair of adjacent seats are pivotally and detachably connected together by means of U-shaped couplers, whereby the adjacent seats are rotatable relative to one another to facilitate the bench being manipulated to one of its axially expanded, folded or collapsed configurations.

The rectangular seats of the bench are held side-by-side one another by a triangular webbing that is attached between each pair of adjacent seats. The seats and the webbing are manufactured from flexible and tear-resistant material that is adapted to be compressed and stretched depending upon whether the bench is manipulated to its axially collapsed or expanded configuration. An optional flap hangs downwardly from the front of each seat. A pair of pockets are attached one over the other against each flap to provide convenient storage compartments for the seated individuals.

DESCRIPTION OF THE PREFERRED EMBODIMENT

Referring initially to FIGS. 1-5 of the drawings, there is shown a collapsible and foldable portable bench 1. In an axially expanded configuration (best shown in FIG. 3), the bench 1 is stretched outward in a straight line in response to pulling forces being applied in opposite directions away from one another to opposite ends of the bench. In its axially expanded configuration, the bench 1 is useful to provide seating for a number of people either out of doors (e.g., at a sporting event or a picnic) or indoors (e.g., in place of a more traditional couch). The bench 1 has a plurality of comfortable rectangular seats 3-1 . . . 3-6 which are aligned side-by-side and independent of one another in which to seat a corresponding number of individuals. The bench 1 shown in FIGS. 1-5 has a total of six seats to seat six individuals. However, the number of seats being shown is for the purpose of example only and is not to be considered as a limitation of this invention.

Figure 1:
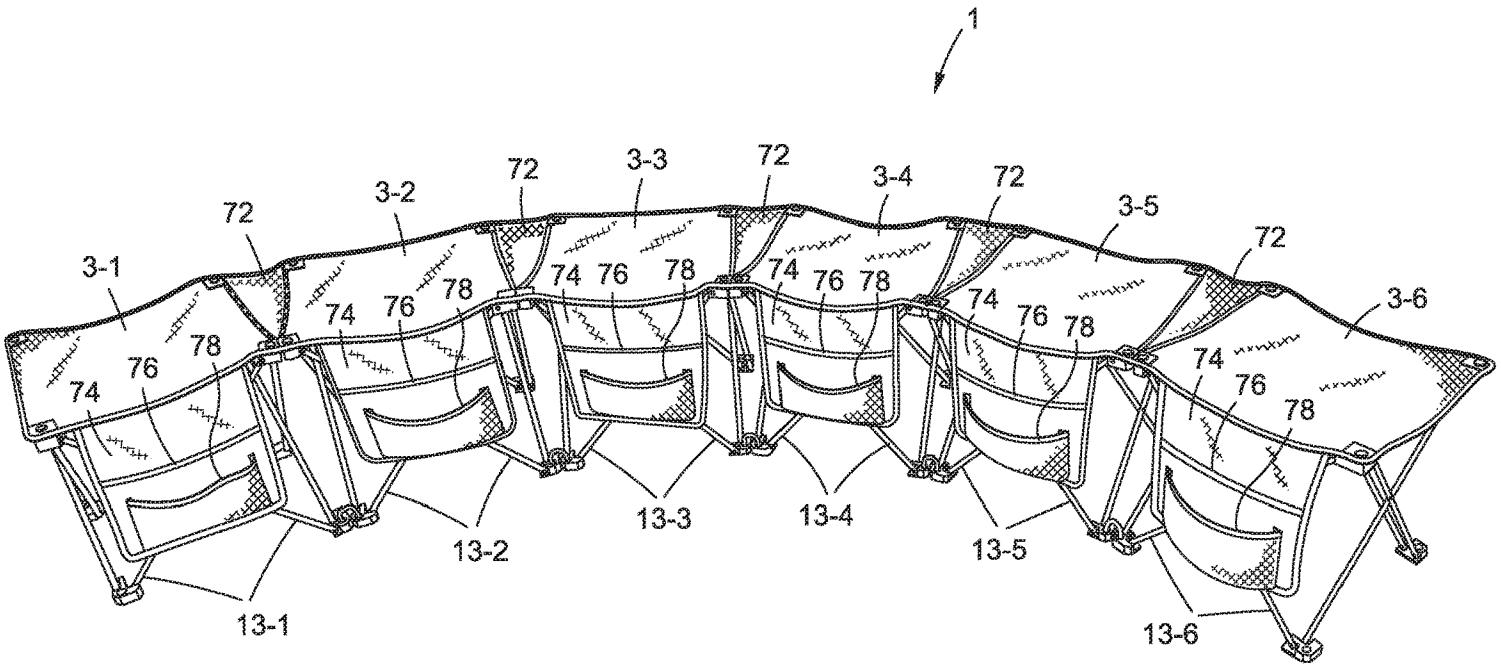
FIG. 1 is a perspective view of a collapsible and foldable portable bench according to the present invention with the bench being curved into a folded configuration.
Figure 4:
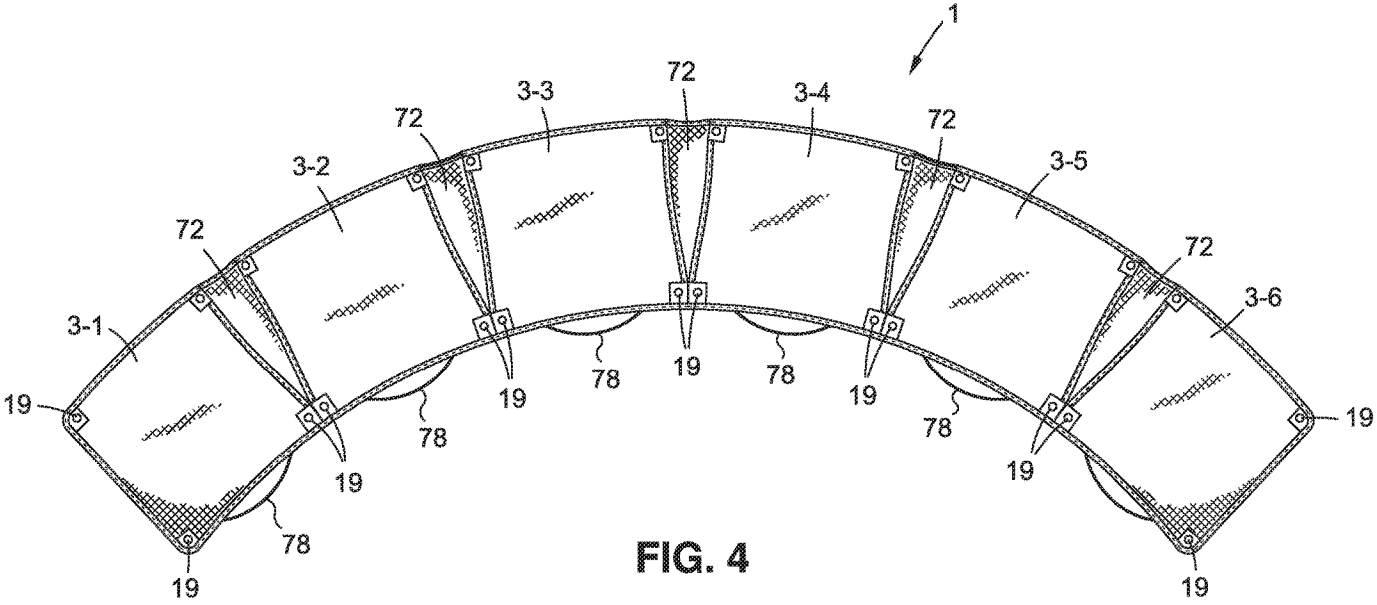
FIG. 4 is a top plan view of the collapsible and foldable portable bench after being bent to its folded configuration of FIG. 1.

FIGS. 1 and 4 show the collapsible and foldable portable bench 1 in a folded or gently curved configuration at which to assume the shape of an arc of a circle. In this case, a downward (or upward) pulling force is applied to each of the opposite ends of the bench 1 after it has first been stretched to its axially expanded configuration of FIG. 3. In its folded configuration, the bench 1 is also suited for use both out of doors and inside. By way of example, the bench 1 is ideal to enable the individuals seated thereon to surround a campfire or listen in close proximity to an entertainer or speaker.

Figure 5:
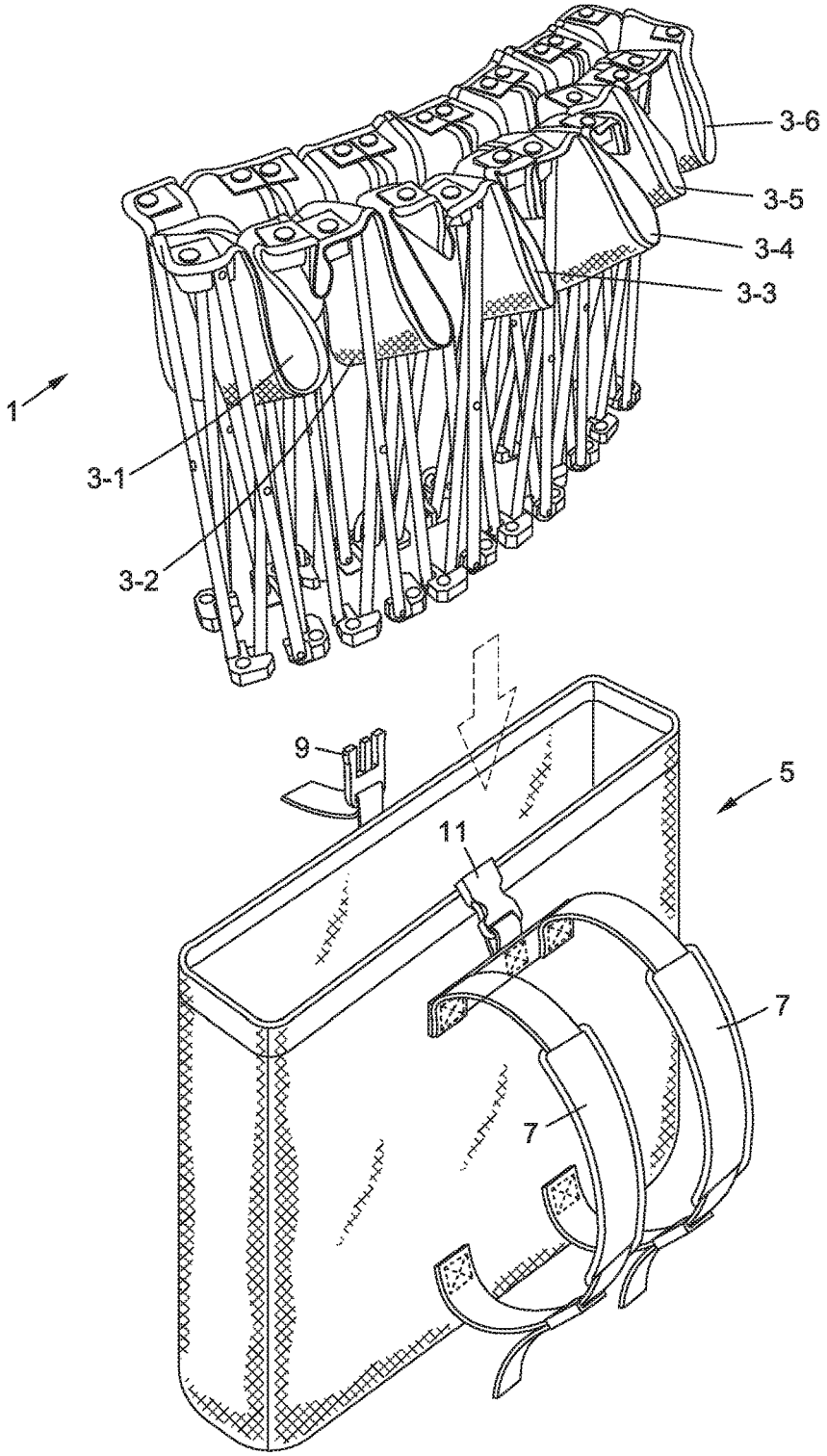
FIG. 5 shows the collapsible and foldable portable bench after being compressed into a compact collapsed configuration suitable to be received by and carried within a backpack.

FIG. 5 shows the collapsible, foldable bench 1 in a collapsed or compressed configuration at which to have a compact size that is ideal for transport and/or storage. In this case, compressive pushing forces are applied in opposite directions towards one another to the opposite ends of the bench 1 to shorten the length of the bench after it has first been stretched to its axially expanded configuration. In its collapsed configuration, the bench 1 is sized to be stored in a pouch or sack 5 and located in the hatch or trunk of a motor vehicle or in a storage space at home or in an outdoor shed.

In the alternative, the pouch 5 can be used as a backpack to be carried on the back of a user to enable the bench 1 in its compact collapsed configuration to be conveniently transported by a single individual. To facilitate its use as a backpack, a pair of shoulder straps 7 are attached to one side of the pouch 5. With the bench 1 first compressed to its collapsed configuration as shown in FIG. 5 and located inside the pouch 5, a locking clip 9 affixed to one side of pouch 5 is detachably connected to a locking receptacle 11 that is attached to the opposite side of the pouch so as to extend over and across the top of the pouch 5 to prevent the bench 1 from falling out while being carried on the user's back.

To enable the collapsible and foldable portable bench 1 to be manipulated and undergo a change of shape between its axially expanded, folded and collapsed configurations, each of the seats 3-1 . . . 3-6 of bench 1 is attached to a frame 13-1 . . . 13-6 that holds the seat off the ground. Each frame from a seat of the bench is pivotally and detachably connected to the frame of an adjacent seat, whereby the seats are held side-by-side and the frames 13-1 . . . 13-6 are rotatable relative to one another. Referring particularly in this regard to FIG. 2, each frame 13-1 . . . 13-6 to which one of the seats 3-1 . . . 3-6 is attached includes four lower floor blocks 15-1 . . . 15-4 and four upper seat blocks 17-1 . . . 17-4. A first pair of the four lower floor blocks 15-1 and 15-2 are spaced below the front of each seat (e.g., 3-5) so as to lay on the ground. A second pair of the four lower floor blocks 15-3 and 15-4 are spaced below the rear of the seat 3-5 so as to lay on the ground behind the first pair of floor blocks 15-1 and 15-2.

A first pair of the four upper seat blocks 17-1 and 17-2 are affixed to the bottom of the seat 3-5 below opposite corners at the front thereof. The first pair of upper seat blocks 17-1 and 17-2 lie above respective ones of the first pair of lower floor blocks 15-1 and 15-2. A second pair of the four upper seat blocks 17-3 and 17-4 are affixed to the bottom of the seat 3-5 below opposite corners at the rear thereof. The second pair of upper seat blocks 17-3 and 17-4 lie above respective ones of the second pair of lower floor blocks 15-3 and 15-4. Each of the upper seat blocks 17-1 . . . 17-4 is connected underneath a corner of the seat 3-5 by means of a fastener 20 (e.g., a rivet or a button head screw) that passed through the seat corner and into a respective one of the upper seat blocks.

Figure 2:
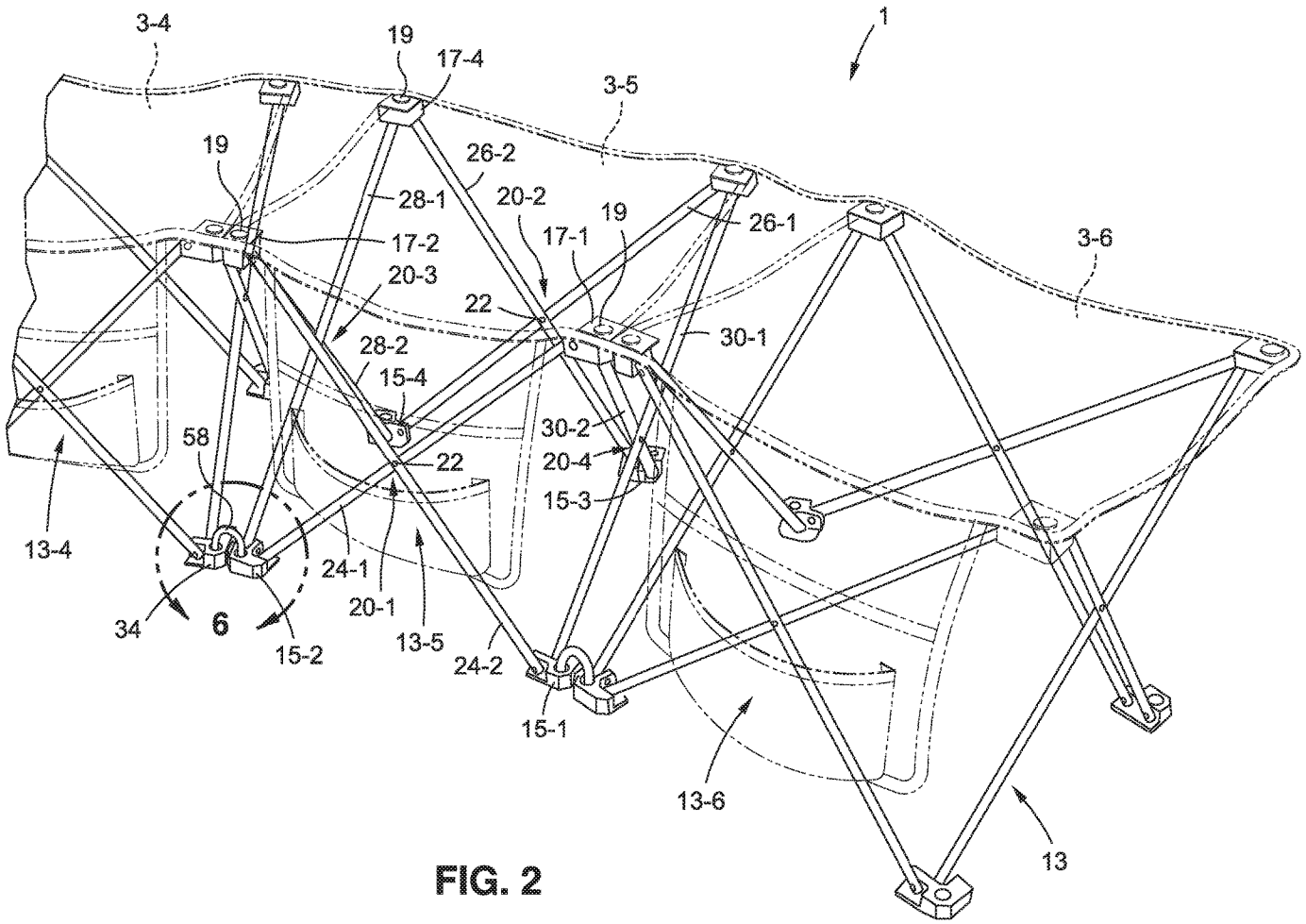
FIG. 2 shows a portion of the collapsible and foldable portable bench of FIG. 1 with a plurality of flexible seats positioned side-by-side one another and attached to respective seat frames that are pivotally and detachably connected together.
Figure 3:
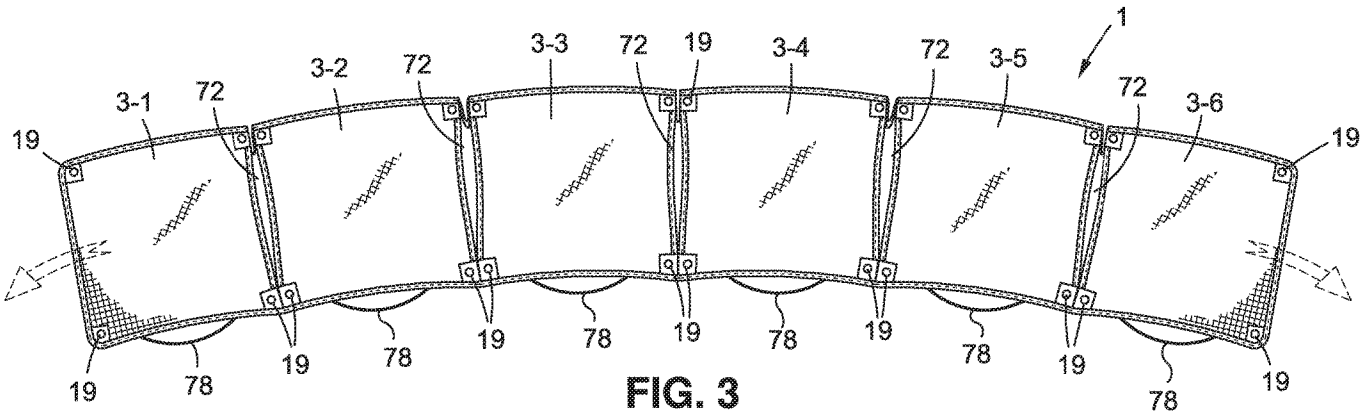
FIG. 3 is a top plan view of the collapsible and foldable portable bench after being stretched to an axially expanded configuration.

Each frame (e.g., 13-5) of each of the seats (e.g., 3-5) of the collapsible and foldable portable bench 1 shown in FIG. 2 has four X-shaped braces 20-1 . . . 20-4 connected between pairs of the lower floor blocks 15-1 . . . 15-4 and pairs of the upper seat blocks 17-1 . . . 17-4. An X-shaped brace 20-1 . . . 20-4 is located at each of the front, back and opposite sides of the frame 13-5 below the seat 3-5. Each X-shaped brace 20-1 . . . 20-4 includes a pair of legs that cross one another at approximately their midpoints. A fastener 22 (e.g., a rivet or a screw) is connected through the midpoints of each of the crossing pairs of legs to establish pivots around which the legs can rotate towards and away from one another whenever the bench 1 is manipulated back and forth between its axially extended, folded and collapsed configurations.

In particular, one end of a first leg 24-1 of a first of the four X-shaped braces 20-1 located at the front of the frame 13-5 below seat 3-5 is connected to one of the pair of lower floor blocks 15-2. The opposite end of the first leg 24-1 of brace 20-1 is connected to one of the pair of upper seat blocks 17-1 which is located diagonally with respect to the lower floor block 15-2. One end of a second leg 24-2 of the first X-shaped brace 20-1 is connected to the other one of the pair of lower floor blocks 15-1. The opposite end of the second leg 24-2 of brace 20-1 is connected to the other one of the pair of upper seat blocks 17-2 which is located diagonally with respect to the lower floor block 15-1.

One end of a first leg 26-1 of a second of the four X-shaped braces 20-2 located at the rear of the frame 13-5 is connected to one of the pair of lower floor blocks 15-4. The opposite end of the first leg 26-1 of brace 20-2 is connected to one of the pair of upper seat blocks 17-3 which is located diagonally with respect to the lower floor block 15-4. One end of a second leg 26-2 of the second X-shaped brace 20-2 is connected to the other one of the pair of lower floor blocks 15-3. The opposite end of the second leg 26-2 of brace 20-2 is connected to the other one of the pair of upper seat blocks 17-4 which is located diagonally with respect to the lower floor block 15-3.

One end of a first leg 28-1 of a third of the four X-shaped braces 20-3 located at one side of the frame 13-5 is connected to the aforementioned lower floor block 15-2. The opposite end of the first leg 28-1 of brace 20-3 is connected to the aforementioned upper seat block 17-4. One end of a second leg 28-2 of the third X-shaped brace 20-3 is connected to the aforementioned lower floor block 15-4. The opposite end of the second leg 28-2 of brace 20-3 is connected to the aforementioned upper seat block 17-2 which lies opposite the upper seat block 17-4 and above the lower floor block 15-2.

One end of a first leg 30-1 of the fourth of the four X-shaped braces 20-4 located at the opposite side of the frame 13-5 is connected to the aforementioned lower floor block 15-1. The opposite end of the first leg 30-1 of brace 20-4 is connected to the aforementioned upper seat block 17-3. One end of a second leg 30-2 of the fourth X-shaped brace 20-4 is connected to the aforementioned lower floor block 15-3. The opposite end of the second leg 30-2 of brace 20-4 is connected to the aforementioned upper seat block 17-1 which lies opposite the upper seat block 17-3 and above the lower floor block 15-1.

It may be appreciated that two legs from each of the X-shaped braces 20-1 . . . 20-4 of each of the frames 13-1 . . . 13-6 of the bench 1 are connected to each one of the lower floor blocks 15-1 . . . 15-4 and to each one of the upper seat blocks 17-1 . . . 17-4. That is, first ends of legs 24-2 and 30-1 are connected to the lower floor block 15-1. First ends of the legs 24-1 and 28-1 are connected to the lower floor block 15-2. First ends of the legs 26-2 and 30-2 are connected to the lower floor block 15-3. First ends of the legs 26-1 and 28-2 are connected to the lower floor block 15-4. Opposite ends of the legs 24-1 and 30-2 are connected to the upper seat block 17-1. Opposite ends of the legs 24-2 and 28-2 are connected to the upper seat block 17-2. Opposite ends of the legs 26-1 and 30-1 are connected to the upper seat block 17-3. Opposite ends of the legs 26-2 and 28-1 are connected to the upper seat block 17-4. Each of the opposite ends of each of the legs of the X-shaped braces 20-1 . . . 20-4 is connected to a respective one of the lower or upper floor blocks and seat blocks 15-1 . . . 15-4 and 17-1 . . . 17-4 by means of a fastener (not shown), such as a rivet or a screw that extends through the leg and into the block.

Figure 8:
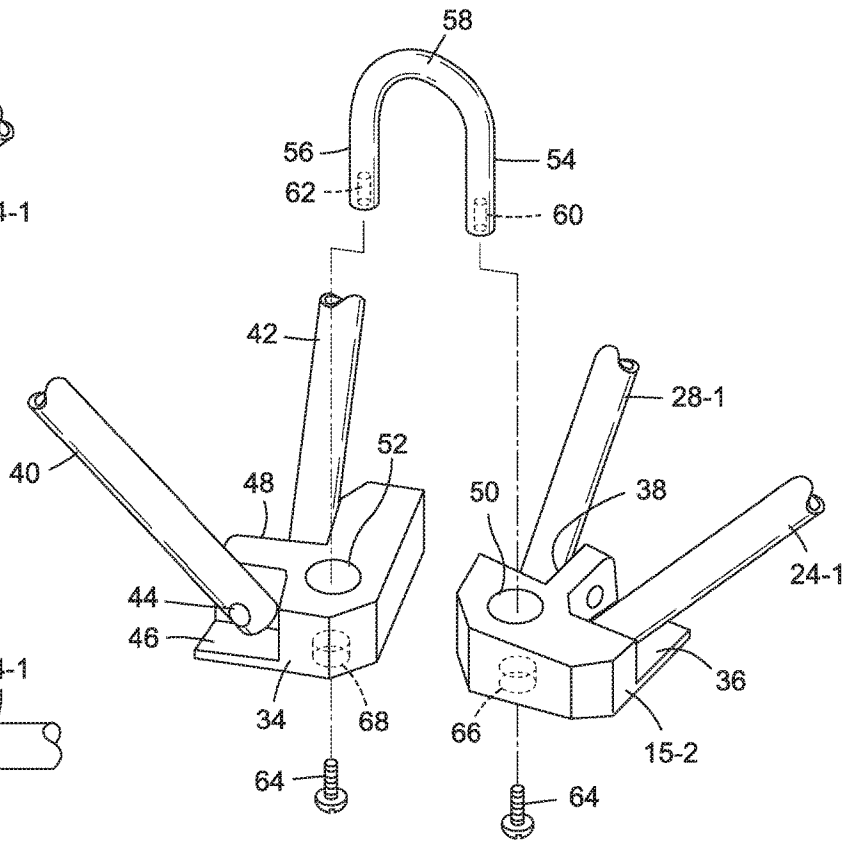
FIG. 8 shows an exploded view of the pair of seat frames of FIGS. 6 and 7 prior to their being pivotally and detachably connected to one another.
Figure 6:
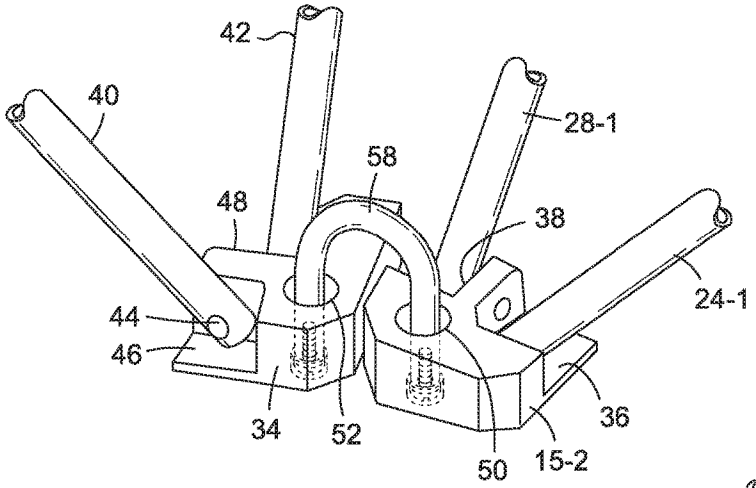
FIG. 6 is an enlarged detail taken from FIG. 2 showing a pair of adjacent seat frames being pivotally and detachable connected to one another.
Figure 7:
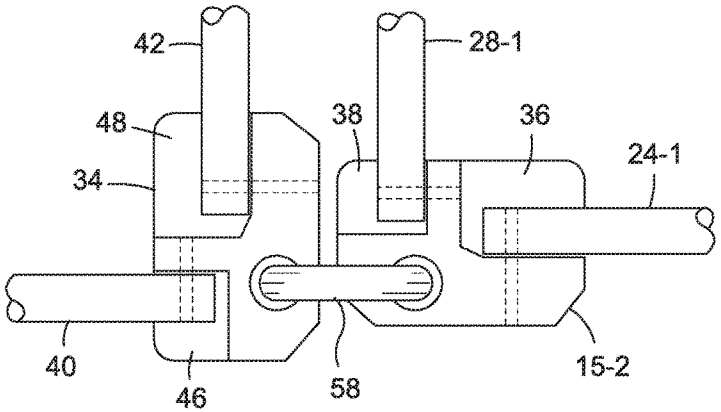
FIG. 7 is a top plan view showing the pair of adjacent seat frames of FIG. 6 being pivotally and detachably connected to one another.

As previously explained, each frame 13-1 . . . 13-6 to which each seat 3-1 . . . 3-6 of the collapsible and foldable portable bench 1 is attached is pivotally and detachably connected to the frame of an adjacent seat. Referring in this regard to FIGS. 6-8 of the drawings, a pair of lower floor blocks 15-2 and 34 that are detailed in FIG. 2 and taken from the frames 13-5 and 13-4 of an adjacent pair of seats 3-5 and 3-4 are shown coupled together. Two of the previously mentioned legs 24-1 and 28-1 from the X-shaped braces 20-1 and 20-3 from the frame 13-5 of one seat 3-5 shown in FIG. 2 are connected by fasteners (best shown in FIG. 7) to the lower floor block 15-2 within respective cavities 36 and 38 thereof. A complementary pair of legs 40 and 42 from identical X-shaped braces of the frame 13-4 of an adjacent seat 3-4 shown in FIG. 2 are connected by fasteners 44 (only one of which being shown) to the lower floor block 34 within cavities 46 and 48 thereof.

Relatively large diameter coupling holes 50 and 52 are formed vertically through the tops of the lower floor blocks 15-2 and 34 of the frames 13-5 and 13-4 of adjacent seats 3-5 and 3-4 so as to lie side-by-side one another. The opposing legs 54 and 56 of a U-shaped coupler 58 are inserted downwardly into respective ones of the coupling holes 50 and 52 so that the closed top of coupler 58 lies above the floor blocks 15-2 and 34. As is best shown in FIG. 8, the bottoms of the legs 54 and 56 of the U-shaped coupler 58 have threaded holes 60 and 62 formed therein for the receipt of respective threaded fasteners 64 which extend upward therewithin.

As is also best shown in FIG. 8, relatively small diameter coupling holes 66 and 68 are formed through the bottoms of the lower floor blocks 15-2 and 34 so as to be axially aligned and communicate with the larger diameter coupling holes 50 and 52 through the tops. When the fasteners 64 are rotated upwardly through the smaller diameter coupling holes 66 and 68 and into mating engagement with the legs 54 and 56 of the U-shaped coupler 58 at the threaded holes 60 and 62 formed therein, the coupler 58 will be removably connected to and held in place between the lower floor blocks 15-2 and 34 of the adjacent seats 3-5 and 3-4. The coupler 58 can also be disconnected from the lower floor blocks 15-2 and 34 when it is desirable to separate the seat 3-5 from the seat 3-4.

As an important feature of this invention, the connection of a U-shaped coupler 58 between an adjacent pair of lower floor blocks (e.g., 15-2 and 34) at coupling holes 50 and 52 allows the adjacent lower floor blocks to pivot around the legs 54 and 56 of the coupler 58. In this same regard, the adjacent seat frames (e.g., 13-5 and 13-4) are correspondingly adapted to rotate relative to one another at the coupled lower floor blocks. By virtue of the foregoing, the bench 1 is made responsive to bending forces applied thereto, whereby the curvature of the bench can be selectively adjusted in order to manipulate the bench into or out of its folded and curved configuration of FIG. 4.

Referring concurrently once again to FIGS. 1-5, the seats 3-1 . . . 3-6 of the collapsible and foldable portable bench 1 are shown being held side-by-side one another with a triangular webbing 72 attached (e.g., sewn) between each pair of adjacent seats 3-1 and 3-2, 3-2 and 3-3, 3-3 and 3-4, 3-4 and 3-5, and 3-5 and 3-6. Both the rectangular seats and the triangular webbing therebetween are manufactured from a flexible and tear-resistant (e.g., cloth) material that is capable of supporting the weight and conforming to the shape of individuals seated in the seats 3-1 . . . 3-6. The alternating seats 3-1 . . . 3-6 and the webbing 72 located therebetween extend continuously across the top of the bench 1 to be connected to the bench frames 13-1 . . . 13-6 by means of the aforementioned fasteners 19 (best shown in FIGS. 3 and 4). By virtue of the flexible nature thereof, the seats and their webbings are adapted to be both compressed and stretched as the bench 1 is manipulated between its collapsed configuration of FIG. 5 and its folded configuration of FIGS. 1 and 4.

As an option, a flap 74 is attached (e.g., sewn) at one end thereof to the front of each of the seats 3-1 . . . 3-6 of the bench 1. The opposite ends of the flaps 74 hang downwardly in front of the seats to which they are attached. A pair of pockets 76 and 78 are attached one over the other so as to lie against respective ones of the downwardly hanging flaps 74. The pockets 76 and 78 provide readily available storage compartments for a seated individual in which to place his glasses, reading material, a snack and the like.

The invention claimed is:

1. Seating means including at least first and second seats for seating first and second individuals, said first and second seats being coupled together so as to enable said first and second seats to be rotated relative to one another, whereby said seating means is movable between an axially expanded configuration where said first and second seats are aligned with one another in a straight line and a curved configuration where said first and second seats are aligned with one another along an arc of a circle, said first seat being attached to and held above the ground by a first frame and said second seat being attached to and held above the ground by a second frame, said first and second frames being pivotally connected to one another to enable said first and second seats to be rotatable relative to one another, each of said first and second frames having a plurality of legs that extend between a respective one of said first and second seats and the around, and one of the plurality of legs from said first frame being pivotally connected to one of the plurality of legs from said second frame, said first frame also having a first leg support laying on the ground to which the one of said plurality of legs from said first frame is connected and a second leg support laying on the ground to which the one of said plurality of legs from said second frame is connected, and said seating means also including a coupler extending between said first and second leg supports, whereby said first and second seats are rotatable relative to one another.

2. The seating means recited in claim 1, wherein each of said first and second seats is manufactured from a flexible material so as to be stretched in response to pulling forces applied thereto and compressed in response to pushing forces applied thereto, said seating means being moved to said axially expanded configuration when said pulling forces are applied to said first and second seats, and said seating means being moved to a collapsed configuration when said pushing forces are applied to said first and second seats, said seating means being longer in said axially expanded configuration than in said collapsed configuration.

3. The seating means recited in claim 1, wherein said coupler extending between said first and second leg supports has a C-shape and first and second legs spaced from and lying opposite one another.

4. The seating means recited in claim 3, wherein each of said first and second leg supports has a coupling hole formed therein, the first and second legs of said C-shaped coupler being received by and retained within respective ones of said coupling holes, whereby said C-shaped coupler is connected between said first and second leg supports and between the one of said plurality of legs from each of said first and second frames.

5. The seating means recited in claim 4, also including removable fasteners by which to detachably connect the first and second legs of said C-shaped coupler to said first and second leg supports within said coupling holes thereof, said C-shaped coupler being disconnected from said first and second leg supports, whereby to enable said first leg support and said first frame to be separated from said second leg support and said second frame.

6. The seating means recited in claim 1, wherein said first and second seats are positioned side-by-side one another, said seating means also including a flexible web located between said first and second seats.

7. The seating means recited in claim 6, wherein said flexible web located between said first and second seats has a triangular shape.

8. A bench including at least first and second flexible seats positioned side-by-side one another for seating first and second individuals and first and second frames to which said first and second flexible seats are respectively attached and held above the ground, said first and second frames being pivotally connected together and rotatable relative to one another in response to pushing, pulling and bending forces applied thereto, whereby said bench is movable to any one of an axially expanded configuration having a first length where said first and second flexible seats are positioned along a straight line, a curved configuration where said first and second flexible seats are positioned along an arc of a circle, and a collapsed configuration where said bench is compressed and has a second length that is shorter than said first length thereof, wherein said bench also includes a flexible web located between said first and second flexible seats, said flexible web being stretched when said bench is in said curved configuration, and said flexible web being compressed when said bench is in said collapsed configuration.

9. The bench recited in claim 8, wherein said flexible web located between said first and second flexible seats has a triangular shape.

10. The bench recited in claim 8, wherein each of said first and second frames has a plurality of legs that extend between respective ones of said first and second flexible seats and the ground, one of the plurality of legs from said first frame being pivotally coupled to one of said plurality of legs from said second frame, whereby said first and said second frames are pivotally connected together and rotatable relative to one another.

11. The bench recited in claim 10, also including a coupler connected between the one of said plurality of legs from said first frame and the one of said plurality of legs from said second frame such that said first and second frames are pivotally connected together and rotatable relative to one another.

12. Seating means including at least first and second seats for seating first and second individuals, said first and second seats being coupled together side-by-side to enable said first and second seats to be rotated relative to one another, whereby said seating means is movable between an axially extended configuration where said first and second seats are aligned in a straight line and a curved configuration where said first and second seats are aligned along an arc of a circle, said first and second seats being joined to one another by a flexible web by which to permit said seating means to be moved between said axially extended and curved configurations.

13. The seating means recited in claim 12, wherein each of said first and second seats is manufactured from a flexible material so as to be stretched in response to pulling forces applied thereto and compressed in response to pushing forces applied thereto, said seating means being moved to said axially extended configuration when said pulling forces are applied to said first and second seats, and said seating means being moved to a collapsed configuration when said pushing forces are applied to said first and second seats, said seating means being longer in said axially expanded configuration than in said collapsed configuration.

14. The seating means recited in claim 12, wherein said flexible web by which said first and second seats are joined to one another has a triangular shape.

* * * * *